United States Patent [19]

Clement, Jr.

[11] 4,189,457

[45] Feb. 19, 1980

[54] METHOD OF SEALING COKE OVENS

[75] Inventor: Henry L. Clement, Jr., Pittsburgh, Pa.

[73] Assignee: H. L. Clement Company, Sewickley, Pa.

[21] Appl. No.: 963,660

[22] Filed: Nov. 24, 1978

Related U.S. Application Data

[63] Continuation-in-part of Ser. No. 848,035, Nov. 3, 1977, abandoned.

[51] Int. Cl.[2] ..... F27D 1/16; C10B 29/00; C10B 25/00

[52] U.S. Cl. ..... 264/30; 49/475; 52/309.8; 52/744; 106/33; 110/173 R; 201/18; 201/41; 202/242; 202/269; 277/72 FM; 264/36; 264/155; 427/140; 427/373; 427/387

[58] Field of Search ..... 202/242, 248, 267, 269; 156/71, 79; 106/33; 260/2.5 S; 49/475; 264/30, 36, 55; 48/124; 266/264, 270, 271, 272, 273, 287; 110/173 R; 52/232, 309.4, 309.8, 744; 277/1, 72 FM, DIG. 6; 201/18, 41

[56] References Cited

U.S. PATENT DOCUMENTS

| | | | |
|---|---|---|---|
| 1,588,725 | 6/1926 | Heinicke | 266/264 X |
| 2,662,053 | 12/1953 | Brown | 202/248 X |
| 2,757,423 | 8/1956 | Wurtz et al. | 260/2.5 S X |
| 3,056,690 | 10/1962 | Welch | 106/33 X |
| 3,450,295 | 6/1969 | Weber, Jr. | 52/309.4 X |
| 3,566,541 | 3/1971 | Coulter | 49/475 |
| 3,687,700 | 8/1972 | Blancquart | 264/30 X |
| 3,798,186 | 3/1974 | Nakade et al. | 260/2.5 S X |
| 3,816,610 | 6/1974 | Lusby | 52/309.4 X |
| 3,875,018 | 4/1975 | Calderon | 202/269 |
| 3,879,240 | 4/1975 | Wall | 52/309.8 X |
| 3,983,082 | 9/1976 | Pratt et al. | 260/2.5 S |
| 4,026,842 | 5/1977 | Lee et al. | 260/2.5 S |
| 4,033,827 | 7/1977 | White, Jr. | 202/248 |
| 4,111,709 | 9/1978 | Price et al. | 202/269 X |
| 4,143,104 | 3/1979 | van Konijnenburg et al. | 264/36 X |

*Primary Examiner*—Joseph Scovronek
*Assistant Examiner*—Roger F. Phillips
*Attorney, Agent, or Firm*—Reed, Smith, Shaw & McClay

[57] ABSTRACT

A method for sealing a by-product coke oven in which a silicone material is caused to foam to form a foaming silicone composition preferably by mixing a first mixture of organohydrogensiloxane and hydroxylated organosiloxane with a second mixture of organohydrogensiloxane most desirably with a platinum catalyst, and heating the mixture to provide a volumetrically expandable foam. The volumetrically expandable foam is sprayed around the periphery of coke oven doors, slip-joints and similar points of gaseous emissions where it undergoes a foaming acting in the presence of the heat of the oven such that the foam volumetrically expands to provide a seal that prevents the emission of gas, dust, and smoke during the coking cycle.

12 Claims, 4 Drawing Figures

FIG 2
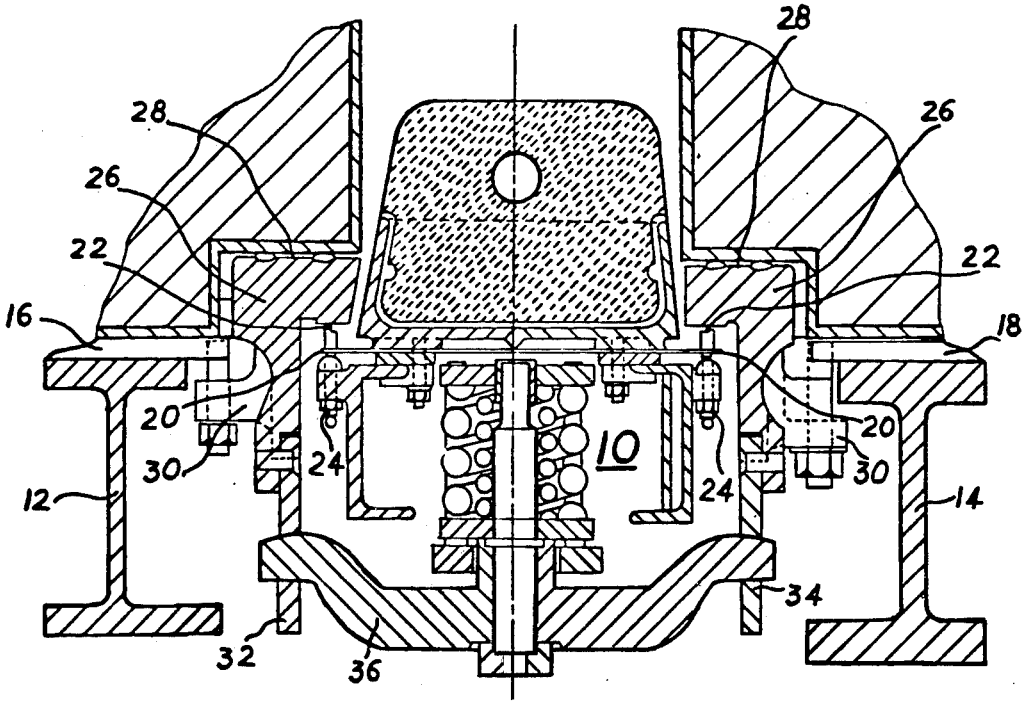
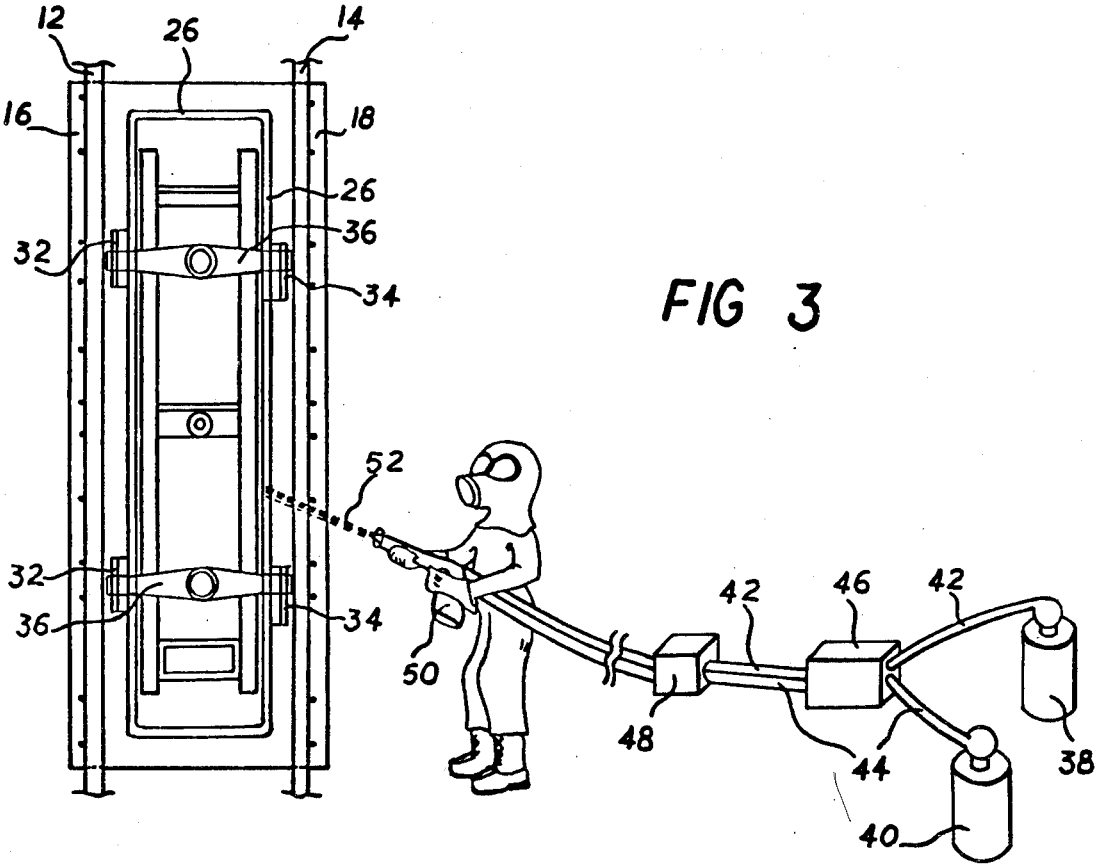
FIG 3

METHOD OF SEALING COKE OVENS

This is a continuation-in-part of application Ser. No. 848,035, filed Nov. 3, 1977 and now abandoned.

BACKGROUND OF THE INVENTION

1. Field of the Invention

The present invention relates to by-product coke ovens and, more particularly, to methods for sealing such coke ovens against the leakage of smoke, dust and noxious by-product gases.

2. Description of the Prior Art

Under current technology, the manufacture of metals and their alloys generally involves refining a quantity of industrially pure metal from its ore. In the case of iron and steelmaking, industrially pure iron is produced by the reduction of iron oxide in a blast furnace. Due to the large quantity of iron which is annually refined, a large quantity of a relatively inexpensive reducing agent is required for the blast furnace reduction process.

The best reducing agent available in the quantities demanded by the blast furnace reduction process has been found to be coke. Coke is obtained by the destruction distillation of selected coals at temperatures typically in the range of 1,650° F. to 2,000° F. Generally, this destruction distillation process is carried on in a retort known as a by-product coke oven. The coke oven is a chamber that is typically eight to twenty feet high, thirty-five to fifty feet long, and twelve to eighteen inches wide. The ovens are laterally arranged in groups, called batteries, to improve their heating efficiency. Various doors are associated with each oven, which include pushing doors, coking doors, chuck doors, charging lids, and elbow covers. Various fluids are carried to and from the oven by pipes and conduits that are connected to the oven by slip-joints.

In the operation of the coke oven, the pushing and coking doors are engagingly set into their respective doorways on opposite ends of the oven, and the oven is filled with coking coal through charging holes in the top of the oven. Charging lids are then placed over the charging holes and the coal in the oven is leveled by a leveling bar inserted through a chuck door opening in the pushing door. When the coal is level, the leveling bar is removed and the chuck door is closed. The oven is then heated until the distillation process is completed after a period of typically 16 to 28 hours. During this period, by-product fluids of the coking process such as flue gas, ammonium sulphate, phenal, naphthalene, benzene, and other fluids are removed as off-gases through an ascension pipe at the top of the coke oven. At the end of the distillation process the pushing and coking doors are removed. A ram is then inserted through the pushing doorway and caused to travel the length of the oven such that the coke is pushed through the coking doorway of the oven into a larry car. The ram is then withdrawn, and the pushing and coking doors replaced in their respective doorways to prepare the oven for the next coking operation cycle.

In addition to the above mentioned doorways, the coke oven is in communication with various other pipes and conduits. For example, each battery of coke ovens is provided with a gas collecting system in which volatile products that are liberated in the coke oven during the coking process are removed from the oven and provided to the gas recovery units. Typically, these gas collecting systems include an ascension pipe or standpipe associated with each coke oven and a collecting main that is connected to all the standpipe of the battery. The volatile gases of each coke oven are carried through respective standpipes to the collecting main which transports the collected gas to the recovery units and the gas products to the tar decanters. Each standpipe is connected to the coke oven by a sealed slip-joint that accomodates the thermal expansion and contraction of the standpipes. Many other examples of the use of such slip-joints also exist.

A pronounced problem in coke oven technology has been the sealing of the coke oven to prevent emissions of gas, dust and smoke during the coking cycle. In the prior art, several techniques for sealing various common emission points of coke ovens have been developed. From the early history of the coking industry, one method for sealing coke oven doors has been to manually place a packing material at the interface between the doorway and the door. This method, known as luting, proved to be unsatisfactory in several respects. First, luting was found to be of limited efficiency for the reason that, over the coking cycle, the luting material would dry and develop cracks through which emissions could pass. Also, with the increased mechanization of coke production, luting came to be recognized as being labor intensive and a hindrance to rapid production, and, consequently, expensive. In addition, the luting process required residual luting material to be cleaned from the door and door jamb at the termination of each coking cycle so that a new application of luting material could be made for the next coking cycle. This residual luting material was difficult to remove. The additional step of cleaning away the residual luting material increased the labor demands of the luting process and further limited significantly the rate at which coke could be produced. Indeed, the luting process as applied to coke oven doors, proved to be slow for use in modern coke ovens in which the entire coking operation is highly mechanized. Today luting of coke oven doors is used only in a few coke oven batteries of small size.

Today coke ovens generally use self-sealing doors. In these doors, a sealing edge is comprised of a knife-edge or a spring loaded stainless-steel strip mounted on a flexible diaphram that adjusts to the contour of the door jamb sealing face. U.S. Pat. Nos. 3,032,483, 2,965,550, 2,207,652, 3,172,825, 3,510,404, and 2,855,347 describe exemplary coke oven doors of this type known to the applicants. The problem with these coke oven doors is that, in view of the size of coke oven doors, even with a diaghram mechanism it is extremely difficult to attain a tight fit over the entire contour of the seal. Furthermore, the doors, which must be set and removed during each coking cycle, are cumbersome to manipulate due to their size and weight so that the seals for this type of door, which are delicate in comparison to the door itself, are frequently damaged during the operation of the coke oven. Also, thermal stresses set up by the coke oven heat cause warping to the degree that a tight seal around the door cannot be maintained. Furthermore, in all cases and particularly where a seal does not form a tight fit, in the operation of the coke oven, tar deposits accumulate on the face of the door jamb which make the face increasingly irregular and a tight seal with the door increasingly more unlikely. Although cleaning machinery for removing these tar deposits has been developed and regular cleaning schedules are commonly established, the tar deposits are extremely difficult to remove and such cleaning operations are not adequately effective. Furthermore, the coke oven attendants are exposed to adverse thermal and ambient working conditions during a typical cleaning process. Therefore, the attendants are understandably reluctant to perform this task and, pragmatically, the schedule for cleaning the doors and door jambs is often not maintained. In any event, such cleaning operations are time consuming and do nothing to remedy the failure to form a tight seal caused by thermal stresses and structural deformations. Indeed, the cleaning operations themselves are one source of such deformations.

Yet another method for sealing coke oven doors has been the injection of coke oven gas through the doors, and from there into the open area around the door seals such as described in German Pat. No. 1,149,330. The injected gas provides a higher pressure at the door seal area to prevent escape of tarry smoke and vapors from the oven interior to the outside. This method has also been adapted to inject the coke oven gas into the door seal area through the door jambs instead of the doors themselves. The problem with this method of sealing oven doors has been that a significant portion of the coke oven gas escapes from the seal area into the atmosphere where it cannot be recovered to provide supplemental heating of the coke oven. Also, the coke oven gas deposited a residue of fluff carbon around the seal area. Although this fluff carbon was found to break up under normal mechanical cleaning methods more easily than tar deposited directly on the door or door jamb, thereby acting as a barrier to the deposition of tar on the door or door jamb, periodic cleaning of the door jamb face and the inner face of the doors was nevertheless required.

Another method of sealing coke oven doors included the use of a heat settable sealant as described in U.S. Pat. No. 3,875,018. As therein proposed, a coke oven door is provided with a passage for the injection of a heat settable sealant which acts as a seal between the door and the door jamb. Initially, the injected heat settable sealant is in fluid form, but after exposure to heat at the perimeter of the door, the sealant solidifies. The solid sealant hardens with a glazed-like surface that facilitates removal of the solid sealant at the completion of the coking cycle. This method, however, suffered from several disadvantages. First, the requirement of new doors having a passage for injection of the heat settable sealant or the equivalent modification of existing doors demanded a large initial capital investment from the user. Also, unless a liquid-tight seal initially existed, crevices between the door and door jamb in combination with the initial liquid state of the sealant created the potential for waste of large amounts of sealant, at least until the sealant had solidified sufficiently to stop flowing and block the flow of liquid sealant at the crevice. Also, the tendency of the sealant to harden permitted emittant leakage around the sealant as a consequence of coke even expansion and contraction under thermal stresses.

In the prior art, the problem of adequately sealing the doors each time they are set in the doorway has presisted. U.S. Pat. Nos. 2,571,597; 1,790,775; 725,746; 1,056,270; 2,878,170; 1,918,760 and 2,662,053 are considered to be further illustrative of the prior art. With regard to the sealing of slip-joints and similar points for potential emission of gas, dust, and smoke, a procedure somewhat similar to the method of sealing doors by luting is still the primary procedure. When the luting material cracks or otherwise deteriorates to a condition such that emittants begin to leak from the slip joints, the luting material must be removed. Removal of luting material at such slip-joints, which is done manually is very difficult and time consuming. Typically slip joint seals of luting material are removed by mechanically chipping or water blast processes. Luting materials used on slip joints include various refractory materials and an asbestos treated rope. Typically, lifetimes of such materials are in the range of one day to six months although longer and shorter periods of service are obtained.

While the luting materials themselves are relatively inexpensive, considerable labor is required to remove the hardened luting material of the old seal and apply to new material. In a typical example, replacement of fifteen standpipe seals for a coke oven battery requires the labor of a three-man crew for two shifts. This equates to three hours and twelve minutes labor for each seal that is changed. It is apparent, therefor, that there was a need for a more convenient, quicker, and inexpensive method for sealing slip-joints such as those connecting the coke oven with pipes and conduits for carrying off-gases of by-product coke ovens.

The imperfect sealing of the coke ovens permitted dust, smoke and noxious by-products of the coking process to escape from the oven. This condition is aggrevated by the fact that a positive pressure is maintained in the oven to prevent the admittance of air into the coking chamber which would seriously damage the quality of coke produced. In the past, the escape of a certain portion of smoke and coking by-products was tolerated to the extent that it did not effect the quality of the coke produced and was the only commercially practicable manner for producing coke. More recently, however, the growing awareness of the environmental implications which the release of such smoke and noxious by-products present, together with a growing concern for the health of persons exposed to such emmittants has made the prior art sealing methods increasingly unacceptable.

The disclosed invention overcomes the problems and difficulties of te prior art by providing a method for sealing coke ovens which is effective to prevent the escape of dust, smoke, coke oven gas, and other coking by-products from the oven during the coking cycle to improve the general environmental impact of the coke oven as well as to conserve the quantity of fuel consumed and the by-products which are produced. In providing these improvements, the disclosed method requires minimal attention and care from coke oven attendants, thus assuring its effectiveness over many coking operation cycles of the oven. Additionally, the method requires no capital investment in new coke oven structures or modifications to existing structures thereby assuring its economic practicality.

SUMMARY OF THE INVENTION

In accordance with the present invention, a method of sealing coke ovens is provided in which a silicone material is caused to foam to form a foaming silicone composition that has the property of volumetrically expanding when subjected to heat. The foaming silicone composition is then applied to points of emission, such as the crevice of slip-joints or the perimeter of doors, where it volumetrically expands to fill any fissures or cavities existing in the slip joint or between the door and the adjacent structure of the coke oven. The expanding foaming silicone forms a foamed silicone composition sealing the coke oven against infiltration of ambient air into the coke oven and the emission of dust, smoke and coke oven by-products from the coke oven.

The silicone material is preferably caused to foam by mixing and agitating separate components of silicone materials. Preferably, the silicone components are also preheated prior to or during their combination to promote the foaming acting and volumetric expansion of the foaming silicone composition. More preferably, the silicone material or the components thereof are preheated to a temperature in the range of 90° F. to 150° F., and, most preferably to a temperature in the range of 105° F. to 125° F.

Preferably, as an initial step, the silicone components are sufficiently mixed and agitated to insure uniformity of foaming within the silicone material. The silicone components are preferably combined and uniformly mixed in a suitable spray gun from which the foaming silicone composition is applied in a spray.

The preferred silicone material is a combination of a first mixture of organohydrogensiloxane and hydroxylated organosiloxane, and a second mixture of organohydrogensiloxane and a catalyst.

Other details, objects and advantages of the invention will become apparent as the following description of a presently preferred method of practicing the invention proceeds.

DESCRIPTION OF THE DRAWING

The accompanying Figures illustrate a presently preferred method of practicing the invention in which:

FIG. 2 shows an enlarged cross-section of the coke oven door of FIG. 1 taken along the lines II—II;

FIG. 3 illustrates the practice of the presently preferred door sealing method in connection with the door of FIGS. 1 and 2.

PREFERRED EMBODIMENT OF THE INVENTION

Figure 1:
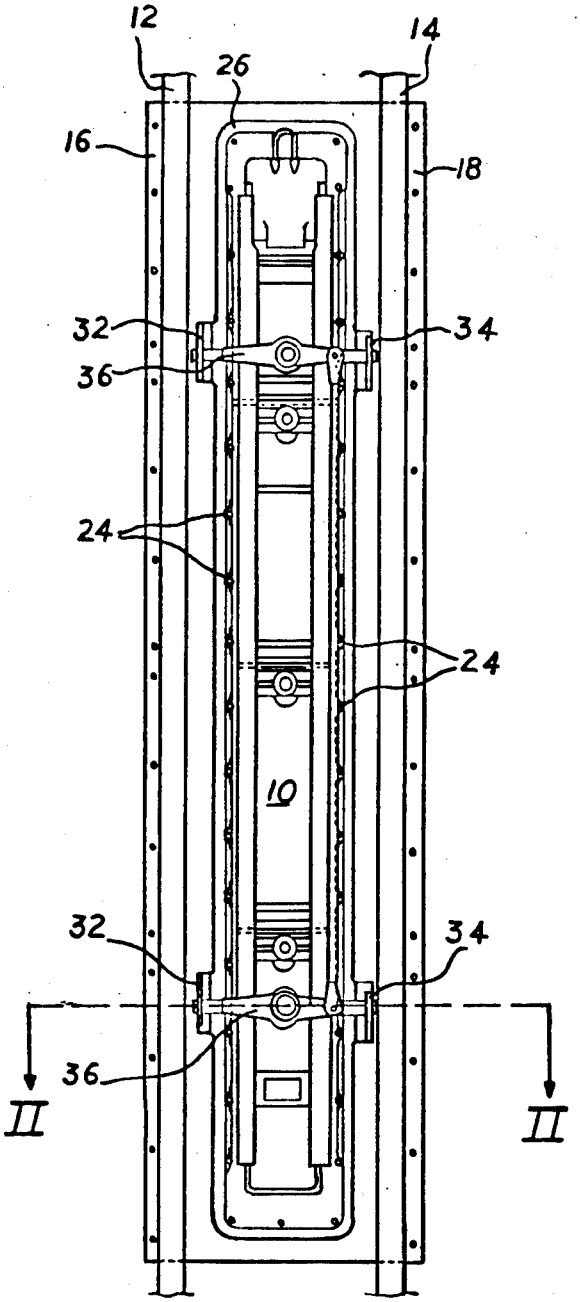
FIG. 1 shows a front elevation of a typical coke oven door of the self-sealing type currently in common use.

FIGS. 1 and 2 show detailed views of a typical coke oven coking door of the self-sealing type. Although a specific example of one type of coke oven door is described for purposes of illustrating a method of the present invention in which a coke oven door is sealed, it will be apparent from the following description that the present method is applicable to all types of coke oven doors including: pushing doors, charging doors, chuck doors, charging lids and elbow covers. Therefore, the use of the term coke oven doors is hereby specifically defined to include these other types of doors in addition to coking doors.

As shown in FIGS. 1 and 2, a coke oven coking door 10 having a generally rectangular shape is located between vertically extending buckstays 12 and 14 which are attached to backing plates 16 and 18 respectively. Backing plates 16 and 18 are fixed to end walls of the coke oven. Coking door 10 includes a flexible door diaphram 20 having a knife-edge seal 22 located about the perimeter of flexible door diaphram 20. Also included are seal adjustment means such as adjustment screws 24 which control the lateral position of knife-edge seal 22.

A door jamb 26 having a sealing surface 28 is fastened around the periphery of the coke oven doorway by fastening means such as flanges 30 which are bolted to buckstays 12 and 14. Door hooks 32 and 34, which are fastened to door jamb 26, laterally project from door jamb 26 and cooperate with latches 36 coupled to coking door 10 to maintain door 10 against door jamb 26 such that the sealing edge of knife-edge seal 22 is maintained against sealing surface 28 of door jamb 26.

Ideally, adjustment screws 24 provide for the lateral adjustment of the distal edge of knife-edge seal 22 to compensate for variation in both knife-edge seal 22 and sealing surface 28 due to manufacturing tolerances and thermal stresses. However, in practice, perfect adjustment is seldom, if ever, obtained. Furthermore, as previously described, knife-edge seal 22 and sealing surface 28 are also subject to accumulation of particulate and tarry substances and structural deformities and warping caused by physical impacts suffered during manipulation and heating of door 10. Efforts to overcome these difficulties have heretofore been largely ineffective and, consequently, the integrity of the door seal has been broken allowing dust, smoke, and coke oven by-product gases to leak through.

In accordance with the practice of the present invention, prior to charging the coke oven, a foaming silicone composition is applied about the periphery of door 10 and between knife-edge seal 22 and sealing surface 28 such that, by volumetric expansion, the foaming silicone composition seals the cracks and crevices existing between knife-edge seal 22 and sealing surface 28, thus providing a tight seal that does not crack during the coking cycle, and otherwise overcomes the difficulties and disadvantages experienced in the prior art.

In the specific example of the presently disclosed method illustrated in FIG. 3, first and second silicone components, which are generally mixtures of materials as hereinafter described, are contained in reservoirs 38 and 40 respectively. Preferably, the first and second silicone materials contained in reservoirs 38 and 40, respectively, are sufficiently agitated to insure their homogeneity. The silicone components are then pumped, under pressure, from their respective reservoirs through parallel fluid lines 42 and 44. A yoke or regulator 46 affords precise control of the relative amounts of each component provided through parallel fluid lines 42 and 44 respectively. It is preferred that fluid lines 42 and 44 carry the silicone components through a heating element 48 which heats the components and silicone materials formed from the components to a temperature in the range of 90° F. to 150° F. More preferably, the silicone components are heated to a temperature in the range of 105° F. to 125° F., and, most preferably, in the range of 110° F. to 120° F.

The heated first and second silicone components are separately provided to a mixing means such as a spray gun 50 which causes a silicone material to be formed that foams to form a foaming silicone composition 52. Spray gun 50 emits the foaming silicone composition 52 in a bead-like spray. Such spray guns are commercially available, an example being a Gusmer-type AR gun head which forms foaming silicone composition 52 by admitting the pressurized silicone components to a chamber through small outlets.

The bead-like spray from spray gun 50 is applied about the perimeter of coking door 10 and between knife-edge seal 22 and sealing surface 28 to which the bead-like spray of foaming silicone composition 52 initially adheres. Foaming silicone composition 52 is responsive to the heat of knife-edge seal 22 and sealing surface 28 such that it volumetrically expands beyond the total volume of the constituent silicone material before foaming to seal the door. The volumetric expansion of foaming silicone composition is such that the ratio of the expanded volume of foaming silicone composition 52 to the total volume of the silicone material before foaming is at least 1.1 to 1 (i.e. at least 10% expansion). More preferably, the ratio of the expanded volume of foaming silicone composition 52 to the total fluid volume of the silicone material before foaming is at least 1.5 to 1 (i.e. at least 50% expansion) most preferably at least 2 to 1 (i.e. at least 100% expansion), and, most desirably at least 4 to 1 (i.e. at least 300% expansion).

After undergoing volumetric expansion so as to form a seal around the perimeter of coking door 10, foaming silicone composition 52 forms a foamed silicone composition sealing the coking door 10, but loses its tendency to adhere to coking door 10 or door jamb 26. Accordingly, the seal formed by the foamed silicone composition is easily removed at the conclusion of the coking cycle.

One composition suitable for use as foaming silicone composition 52 is a mixture of organohydrogensiloxene, hydroxylated organosiloxane, and a catalyst such as described in U.S. Pat. No. 3,923,705 to S. B. Smith. Preferably, the silicone material is a first silicone mixture of organohydrogensiloxane and hydroxylated organosiloxane, and a second silicone mixture of organohydrogensiloxane most desirably with the addition of a catalyst. The catalyst can be a platinum catalyst of the type more particularly described in U.S. Pat. No. 3,923,705. More preferably, the silicone material consists of Components A and B respectively of RTV Silicone Foam (e.g. #3-6548 or #3-6560) manufactured by Dow Corning Corporation. Most desirably, regulator 46 is adjusted such that Components A and B are provided to fluid lines 42 and 44 in equal proportions by volume. It has been found that the mixture of Components A and B of RTV Silicone Foam causes the silicone material to undergo immediate volumetric expansion, particularly in the presence of heat, even as the foaming silicone composition is being applied in a bead-like spray. Moreover, the resulting foaming composition further expands into a closed cellular structure when exposed to the heat of coking door 10 and door jamb 26 to form a foamed silicone composition. Initially, typically for a period of approximately ten seconds, this further expansion proceeds at a rapid rate and is sufficient to form a tight seal which maintains itself between coking door 10 and door jamb 26 during the coking cycle. Advantageously, after the initial period of rapid expansion, the foamed silicone composition, under continued exposure to heat, undergoes still further expansion at a lower rate, further improving its sealing capability and its positional security. Furthermore, the closed cellular structure of the resulting foamed silicone composition in its expanded state preferably retains a resiliency which allows it to flex in response to the thermal stresses experienced by the coke oven throughout the coking cycle and maintain a good seal.

Also, advantageously, it has been found that the resulting foamed silicone composition positionally maintained by its expansive property, has little tendency to adhere to oven door 10 or door jamb 26 during the coking cycle without difficult scraping or cleaning procedures. Moreover, in the event that any foamed silicone composition is inadvertently left on door 10 or door jamb 26, it has not been found to be detrimental to the subsequent sealing of the coke oven door with the foaming silicone composition.

As is apparent from the foregoing description, with regard to self-sealing coke oven doors, the disclosed method can be applied with equal facility to other types of by-product coke oven doors. These include pushing and coking doors designed for luting as well as chuck doors, charging lids and elbow covers. In the case of sealing certain types of doors, such as chuck doors, one slight modification to the method previously described has been found to be advantageous. In accordance with this method, the foaming silicone composition is sprayed directly on the face of the door and/or door jamb while the door is in an open position. Thereafter, the door is closed such that the foaming silicone composition is interposed between the door and the door jamb or perimeter of the door opening. A seal is then formed between the door and the door jamb at the perimeter of the door opening through the volumetric expansion of the foaming silicone composition.

The invention is further illustrated by the following non-limiting example.

EXAMPLE

Five gallons of Component A and five gallons of Component B of Dow Corning 3-6548 were each separately mixed for a period of five minutes with air motor driven equipment. After agitation, a small Graco pump was mounted on top of each container, and the pumps coupled by separately heated pipelines to a Gusmer-type spray machine. Components A and B were thus delivered to a mixing chamber in the spray machine preheated to a temperature of about 110°–120° F., where the components were metered into the mixing chamber in a ratio of 1 to 1 and the silicone material caused to foam. From the mixing chamber, the silicone material was delivered under pressure through 3 to 4 inch flexible tubing to a Gusmer-type AR spray gun head.

From the spray gun head, the foaming silicone composition was applied in a bead like spray around the crevice between the coking door and door jamb of a coke oven door from a distance of several inches. The coking door fitted snugly against the jamb, but the imperfections in lining-up the door and jamb from wear and warping allowed gases and smoke to escape. The foaming silicone composition was applied after the door was in place and the oven heated for charging. The nominal application thickness was approximately 1 to 3 inches. The heat of the coke oven door at approximately 225° to 550° F. caused the foaming silicone composition to volumetrically expand on contact and within ten seconds from an initial set foamed silicone composition. The foaming silicone composition that penetrated the crevice at the coke oven door become a closed cell-structured solid material which was black in color. The foamed silicone composition volumetrically expanded 300 to 400% and weighed 17 to 25 pounds per cubic foot in its initial cured state. The amount of material applied was about 1.5 pounds, and the time of application was about 2 to 3 minutes.

After application, the foamed silicone composition sealed the coke oven door so that no emissions of gases or smoke were observed during the coking cycle. It was noted during the coking cycle that the foamed silicone composition continued to expand somewhat in the presence of the constant heat at the coking door/jamb crevice. This continued expansion during the coking cycle continued to increase the sealing capacity of the foamed silicone composition. The closed cell structure of the foamed silicone composition stayed consistent during subjugation to the heat of the coke oven, but remained flexible. During the coking cycle, the foamed silicone material charred in the 1/32 to 1/16 inch in close contact with the door and jamb, but the door remained sealed against emissions of gases and smoke.

After 28 hours, which is the normal length of time required to coke coal in the tested coke oven, the foamed silicone composition still sealed the door against gas and smoke emissions. When the door was opened, the foamed silicone composition fell off or could be knocked off the door and jamb with the slightest effort. The foamed silicone composition had little or no adhesive quality and was readily cleaned from the door jamb.

The seal by the foamed silicone composition was declared a success by those observing. It was observed that no other material had successfully sealed the coke oven door for the duration of the coking cycle. It was also observed that the presence of the foamed silicone composition caused no difficulty on sealing with the same material in the next coking cycle.

In addition, it was observed that the time for formation of the initially cured foamed silicone composition could be adjusted by the additions of amounts of platinum catalyst to one of the components of the foaming silicone composition.

Figure 4:
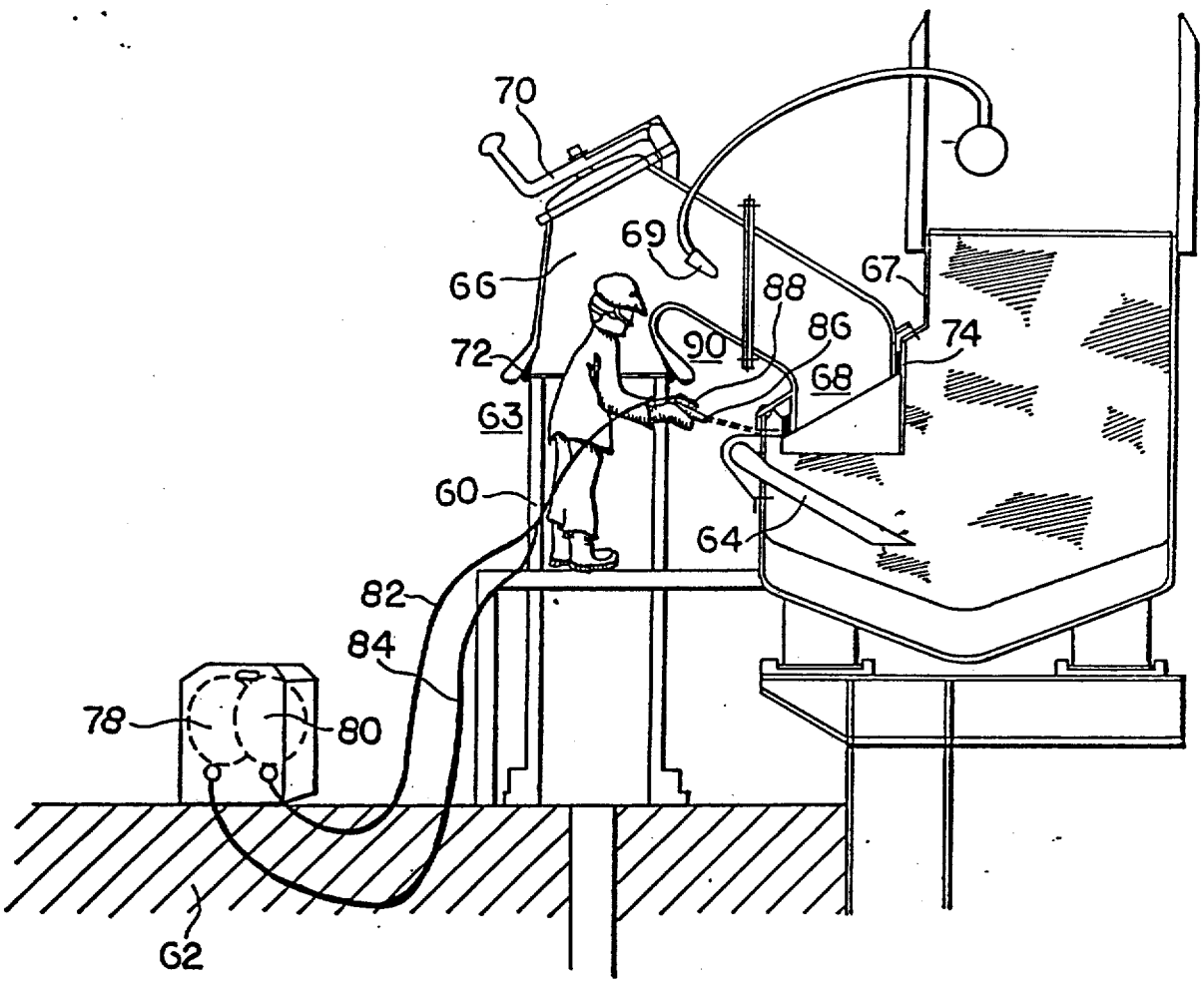
FIG. 4 shows a cross-section of an ascension pipe, gooseneck, and collecting main associated with a coke oven.

A second preferred method for practicing the invention is described with respect to FIG. 4. FIG. 4 is a partial view of a longitudinal cross-section of a coke oven showing an ascension pipe or standpipe 60 connected at one end to the top of one oven of a coke oven battery. The opposite end of the standpipe is connected by a slip-joint 63 to a damper valve 64 through a gooseneck 66. A spray nozzle 69 is also provided for flushing gooseneck 66 with a flushing liquor that is the condensate from the volatile products driven off in the coking process. Damper valve 64 is usually liquid-sealed valved designed such that a cooling spray sprayed in the gooseneck seals valve 64 when it is in the closed position. Gooseneck 66 is connected to a collecting main 67 by a second slip-joint 68. Gooseneck 66 is provided with an elbow cover 70 that vents the oven to the atmosphere when open. Each coke oven if the battery is similarly connected to collecting main 67 so that the collecting main is associated with a multiple of coke ovens. For example, the collecting main may service as many as seventy or more coke ovens.

In the typical operation of the fluid-collecting system of FIG. 4, volatile products that are liberated in the coke oven during the coking process are carried through standpipe 60 and gooseneck 66 to the collecting main 67. In passing through gooseneck 66, the gas is shock cooled by the flushing-liquor spray to precipitate tar from the gas, and to cool the gas to the desired temperature. The other ovens of the battery are similarly connected to collecting main 67 which serve to collect gas from the ovens and also controls pressure in the ovens during the coking process. The pressure is regulated by a controller (not shown) located between the collecting main and a suction main that carries the gas to the various recovery units. Also, the collecting main transports the products condensed from the gas by the flushing liquor to the tar decanters.

Slip-joints 63 and 68 are provided to allow for thermal expansion and contraction of the various members of the gas-collecting system with respect to the coke oven. In accordance with the present invention, slip-joints 63 and 68 are respectively provided with seals 72 and 74 to prevent the escape of volatiles from the coke oven into the atmosphere.

Seals 72 and 74 can be applied to slip-joints 63 and 68 in accordance with the method and apparatus described with respect to FIGS. 1–3. However, the slip-joints are relatively small in comparison to the pushing or coking doors of the oven so that much less silicone material is required to comprise the slip-joint seals then is required to seal coke oven door 10. Also, the slip-joints are widely displaced over the coke oven battery so that repair of the slip-joint seals must occur in a somewhat irradic physical pattern. Accordingly, the preferred apparatus for sealing slip-joints on the coke oven is somewhat modified from the apparatus of FIG. 3 for sealing coke oven doors.

Accordingly, in an alternative embodiment, the first mixture of organohydrogensiloxane and hydroxylated organosiloxane is combined with the second mixture of organohydrogensiloxane and a catalyst in a mixing vessel located adjacent the slip-joint. The first and second mixtures are agitated in the mixing vessel until they are throughly mixed. This mixture remains in a fluid state for a time period of about five to ten minutes depending upon various parameters including the temperature of the mixture and the relative concentration of the catalyst. While the mixture is fluid, it is poured into the slip-joint where it volumetrically expands to provide seal 74.

However, the preferred apparatus for practicing the present invention in connection with slip-joints is illustrated in FIG. 4. FIG. 4 includes a first pre-pressurized container 78 for holding a first mixture of organohydrogensiloxane and hydroxylated organosiloxane and a second pre-pressurized container 80 for holding a second mixture of organohydrogensiloxane and a catalyst. Pre-pressurized containers 78 and 80 are connected by hoses 82, 84 to a nozzle 86 through a metering device 88. Preferably, nozzle 86 and metering device 88 are contained in an integral gun-type housing such as is available from Iusta-Foam Products Company. Preferably, gun-type housing also includes a fluid switch for controllably interrupting the fluid flow from tanks 78 and 80. Also preferably, nozzle 86 is an expendible type nozzle that is disposed of and is replaced with another nozzle when it becomes clogged or obstructed.

In the practice of the present invention as illustrated in FIG. 4, pre-pressurized containers 78 and 80, are respectively filled with a first mixture of organohydrogensiloxane and hydroxylated organosiloxane, and a second mixture of organohydrogensiloxane and a platnum catalyst at a selected pressure. Preferably, the capacity of containers 78 and 80 is in the range of 18 fluid ounces to 2.5 gallons so that they can easily be transported about the top surface of the coke oven battery by a human operator. Containers 78 and 80 are connected to spray gun 90 in which the flow of the first and second mixtures to the nozzle 86 is metered by metering device 88. Basically, metering device 88 is a chamber having orifaces that control the flow of the first and second mixtures in accordance with their respective viscosities and pressures. By use of metering device 88 in combination with pre-pressurized containers 78 and 80, the need for a pump mechanism and regulator is avoided. This is advantageous in that the bulk and weight of the apparatus that must be borne by the operator is significantly reduced. Moreover, it eliminates the need for an available power source for pumping the mixtures or, alternatively, for the operator to prime a mechanical pump, thus allowing the seal to be applied with increased efficiency.

Also in metering device 88, the first and second mixtures are mixed together to form an organosiloxane foaming composition. The organosiloxane foaming composition is provided to expendable nozzle 86 which directs the foaming composition in a bead-like spray 92. Under the guidance of the operator, the bead-like spray is applied around the circumference of the slip-joint such that the organosiloxane foaming composition volumetrically expends to form a seal for the slip-joint. The volumetric expansion is preferably such that the ratio of the volume of foamed silicone composition to the total volume of the silicone material before foaming is in the range of at least 1.1 to 1 and, more preferably, in the range of at least 2 to 1.

The composition of the foaming composition is such that its volumetric expansion is accelerated by the heat of the coke oven. However, further acceleration of the volumetric expansion can be obtained where desired by heating containers 78 and 80. This may be accomplished by appropriately insulating container 78 and 80 and performing a preliminary step of heating containers 78 and 80 in a specialized induction or conviction heating mechanism, or by heating in accordance with other techniques.

The preferred method of producing a beak-like spray of foaming silicone composition is particularly advantageous over merely combining the first and second mixtures in a mixing vessel at the slip-joint and pouring that mixture around the slip-joint to form the seal. Specifically, providing a spray of silicone composition in which foaming action has already begun enables the silicone composition to very rapidly establish a self-maintaining structure within the slip-joint such that it does not flow out or fall out of the slip-joint. This is especially important in circumstances were the slip-joints are out of a horizontal plane or when the seal is a bottom-type seal that must be applied from below the slip-joint such as for slip-joint 63 shown in FIG. 4.

Another advantage of the preferred method is that it is somewhat more efficient in the use of the first and second mixture that are combined to form the foaming silicone composition. Specifically, in the preferred method, the mixtures are combined in the chamber of a gun and ejected immediately therefrom. Therefore, the preferred method avoids the potential for a portion of the foaming composition to coagulate and solidify on the walls of a container such as can occur where the first and second mixtures are mixed together in a mixing vessel located adjacent the slip-joint.

After undergoing volumetric expansion so as to form a seal around slip-joints 63 and 68, the foaming silicone composition forms a foamed silicone composition that seals the slip-joint, but steadily losses its tendency to adhere directly to the slip-joint. Accordingly, the seal formed by the foamed silicone composition is easily removed when it is broken so that it can be easily replaced without need for slow and difficult cleaning procedures such as chipping and water blast techniques.

In one example where the present invention was actually used to seal slip-joints, luting material was cleaned from the slip-joints by chisels and other impact tools. A three man crew worked two shifts to clean this old-style luting material from nine slip-joints. This equates to more than five hours of labor per slip-joint. Then, in accordance with the present invention, the foaming composition was applied to the slip-joints using equipment described with respect to FIG. 1. The composition was applied to the nine slip-joints in less than one hour, with most of this time being required for set up of the equipment. The actual application of the foaming composition actually required only about eighteen to twenty-seven minutes. This equates to about two to three minutes per slip-joint. When seals formed in accordance with the present invention were replaced, it was found that removal of the seal was easily accomplished without special tools in about two to three minutes. This is in contrast to the five hours per slip-joint required in cases where prior art luting materials were used.

In a second example, similar results were obtained. Specifically, four slip-joints were sealed in accordance with the present invention in about ten minutes.

While preferred methods of practicing the presently disclosed invention have been shown and described, it is to be understood that the invention is not limited thereto, but may be otherwise variously practiced within the scope of the following claims.

I claim:

1. A method of sealing leaks and crevices in a by-product coke oven, said method comprising the steps of:

causing a silicone material to foam to form a foaming silicone composition; and applying the foaming silicone composition to the leak such that the composition volumetrically expands beyond the total volume of the silicone material before foaming to form a foaming silicone composition sealing the leak.

2. The method of claim 1 wherein the volumetric expansion of foaming silicone composition is such that the ratio of the volume of foamed silicone composition to the total volume of the silicone material before foaming is at least 1.1 to 1.

3. The method of claim 1 wherein the volumetric expansion of foaming silicone composition is such that the ratio of the volume of foamed silicone composition to the total volume of the silicone material before foaming is at least 2 to 1.

4. The method of claim 1 further comprising an initial step of:

agitating separate components of the silicone material for forming the foaming silicone composition.

5. The method of claim 4 further comprising the step of:

heating the silicone material after agitating the separate components, and at least prior to forming the foaming silicone composition.

6. The method of claim 5 wherein said heating step elevates the temperatures of the silicone material to within the range of 90° F. to 150° F.

7. The method of claim 5 wherein said heating step elevates the temperatures of the silicone material to within the range of 105° F. to 125° F.

8. A method of sealing a by-product coke oven, said method comprising the steps of:

mixing an organohydrogensiloxane, a hydroxylated organosiloxane, and a catalyst to form an organosiloxane foaming composition; and applying said organosiloxane foaming composition adjacent to a leak such that the organosiloxane foaming composition volumetrically expands to seal the leak.

9. A method of sealing leaks in a by-product coke oven, said method comprising the steps of:

agitating a first mixture of organohydrogensiloxane and hydroxylated organosiloxane, and agitating a second mixture of organohydrogensiloxane and a catalyst;

heating said first and second mixtures to a temperature in the range of 90° F. to 150° F.;

mixing said first and second heated mixtures together to provide an organosiloxane foaming composition;

applying said organosiloxane foaming composition around the periphery of the leak such that said organosiloxane foaming composition volumetrically expands beyond the total, unmixed volume of said first and second heated mixtures from which the organosiloxane foaming composition is provided, said volumetric expansion occurring in response at least in part to the heat at the perimater of said leak to form seal said leak.

10. A method of sealing coke ovens as described in claim 9, said method comprising the additional step of:

pumping said first and second mixtures under pressure so that they are uniformly mixed and are applied around said leak in a bead-like spray.

11. A method of sealing doors on a by-product coke oven comprising the steps of:

causing a silicone material to foam to form a foaming silicone composition;

applying the foaming silicone composition about the perimeter of a coke oven door opening such that the composition volumetrically expands beyond the total volume of the constituent silicone material; and closing the door over the door opening to interpose the composition between the door and the perimeter of the door opening such that the volumetric expension of the composition seals the door.

12. A method of sealing doors on a by-product coke oven comprising the steps of:

agitating a first mixture of organohydrogensiloxane and hydroxylated organosiloxane, and agitating a second mixture of organohydrogensiloxane and a catalyst;

heating said first and second mixtures to a temperature in the range of 90° F. to 150° F.;

mixing said first and second heated mixtures together to provide an organosiloxane foaming composition applying the organosiloxane foaming composition about the perimeter of the door opening such that the organosiloxane foaming composition volumetrically expends beyond the total volume of the unmixed first and second mixtures; and closing the door over the door opening to interpose the organosiloxane foaming composition between the door and the perimeter of the door openion such that the volumetric expansion of the organosiloxane foaming composition seal the door.

* * * * *

UNITED STATES PATENT AND TRADEMARK OFFICE

CERTIFICATE OF CORRECTION

PATENT NO. : 4,189,457

DATED : February 19, 1980

INVENTOR(S) : Henry L. Clement, Jr.

It is certified that error appears in the above-identified patent and that said Letters Patent are hereby corrected as shown below:

Column 1, line 25, delete "tion" and substitute --tive--. Same column, line 27, delete "destruction" and substitute --destructive--.

Column 2, line 37, delete "proved to be slow" and substitute --proved to be too slow--.

Column 3, line 57, delete "even" and substitute --oven--.

Column 4, line 37, delete "emmit-" and substitute --emit- --. Same column, line 41, delete "te" and substitute --the--.

Column 7, line 24, delete "organohydrogensiloxene," and substitute --organohydrogensiloxane,--.

Column 10, line 55, delete "plat-" and substitute --plati- --.

UNITED STATES PATENT AND TRADEMARK OFFICE

CERTIFICATE OF CORRECTION

PATENT NO. : 4,189,457

DATED : February 19, 1980

INVENTOR(S) : Henry L. Clement, Jr.

It is certified that error appears in the above-identified patent and that said Letters Patent are hereby corrected as shown below:

Column 11, line 32, delete "beak-like" and substitute --bead-like--. Same column, line 48, delete "mixture" and substitute --mixtures--.

Column 13, line 20, delete "perimater" and substitute --perimeter--.

Column 14, line 9, delete "expension" and substitute --expansion--. Same column, line 23, delete "expends" and substitute --expands--. Same column, line 27, delete "openion" and substitute --opening--.

The drawings include Figure 4, as attached hereto.

Signed and Sealed this

Tenth Day of June 1980

[SEAL]

Attest:

SIDNEY A. DIAMOND

Attesting Officer

Commissioner of Patents and Trademar